US007159272B2

(12) United States Patent
Holsten et al.

(10) Patent No.: US 7,159,272 B2
(45) Date of Patent: Jan. 9, 2007

(54) DETACHABLE ACCESSORY HOLDER

(75) Inventors: Stuart V Holsten, O'Fallon, MO (US); Mark J Tomasiak, O'Fallon, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/063,797

(22) Filed: May 14, 2002

(65) Prior Publication Data

US 2003/0213090 A1 Nov. 20, 2003

(51) Int. Cl.
*A47L 9/00* (2006.01)

(52) U.S. Cl. ..... 15/323; 15/353

(58) Field of Classification Search ..... 15/257.01, 15/257.05, 257.1, 323, 353; 220/23.4, 23.86, 220/480, 481, 697, 735, 736
See application file for complete search history.

(56) References Cited

U.S. PATENT DOCUMENTS

| | | | | | |
|---|---|---|---|---|---|
| 2,277,737 | A * | 3/1942 | Wilkinson | 210/249 |
| 3,253,294 | A * | 5/1966 | Waters | 15/323 |
| 3,707,242 | A * | 12/1972 | Golden et al. | 220/570 |
| 3,757,380 | A * | 9/1973 | Jackson | 15/257.05 |
| 5,137,156 | A * | 8/1992 | Riczinger et al. | 211/13.1 |
| 5,213,294 | A * | 5/1993 | DeBord | 248/147 |
| 5,247,719 | A * | 9/1993 | Wareham et al. | 15/323 |
| 5,303,447 | A * | 4/1994 | McKnight | 15/323 |
| 5,313,686 | A * | 5/1994 | Berfield | 15/323 |
| 5,528,794 | A | 6/1996 | Tomasiak | 15/323 |
| D374,523 | S | 10/1996 | Tomasiak | D32/31 |
| 6,237,187 | B1 | 5/2001 | Hult et al. | 15/323 |
| 6,260,233 | B1 * | 7/2001 | Wareham et al. | 15/323 |
| D447,609 | S | 9/2001 | Hult et al. | D32/31 |
| 2003/0024067 | A1 * | 2/2003 | Roney et al. | 15/323 |
| 2003/0106181 | A1 * | 6/2003 | Kim | 15/323 |

OTHER PUBLICATIONS

Shop-Vac Brochure, Lowe's Home Improvement Warehouse, 2001.

* cited by examiner

*Primary Examiner*—Terrence R. Till
(74) *Attorney, Agent, or Firm*—Locke Liddell & Sapp LLP

(57) ABSTRACT

The present invention provides a holder for storing accessories on a wet/dry vacuum. The holder securely attaches to the vacuum and readily detaches therefrom. The detachable holder may be detached with the accessories. While an operator dumps debris out of the drum of the vacuum, detaching the holder prevents the accessories from being inadvertently spilled out of or discarded from the holder. The detachable accessory holder fully secures to a bracket attached to the vacuum. The secure attachment prevents the holder from falling off or tipping on the vacuum. To attach the holder to the bracket and vacuum, grooves on the holder are set on to an axle of the vacuum. As the holder is pivoted about the axle, tabs and a latch on the holder engage slots and a step on the bracket. To remove the holder, the operator presses on the latch and lifts the holder from the bracket and the appliance.

19 Claims, 8 Drawing Sheets

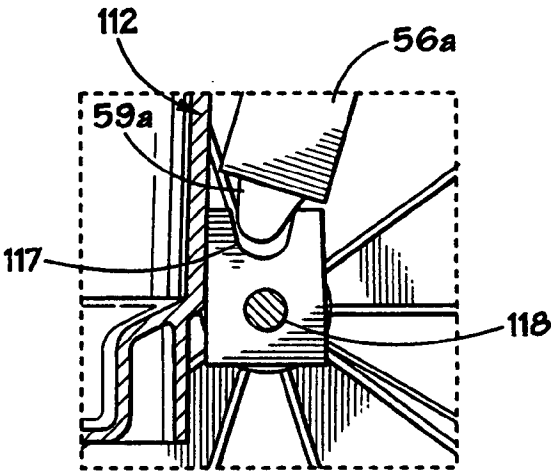
FIG. 4C
FIG. 4B
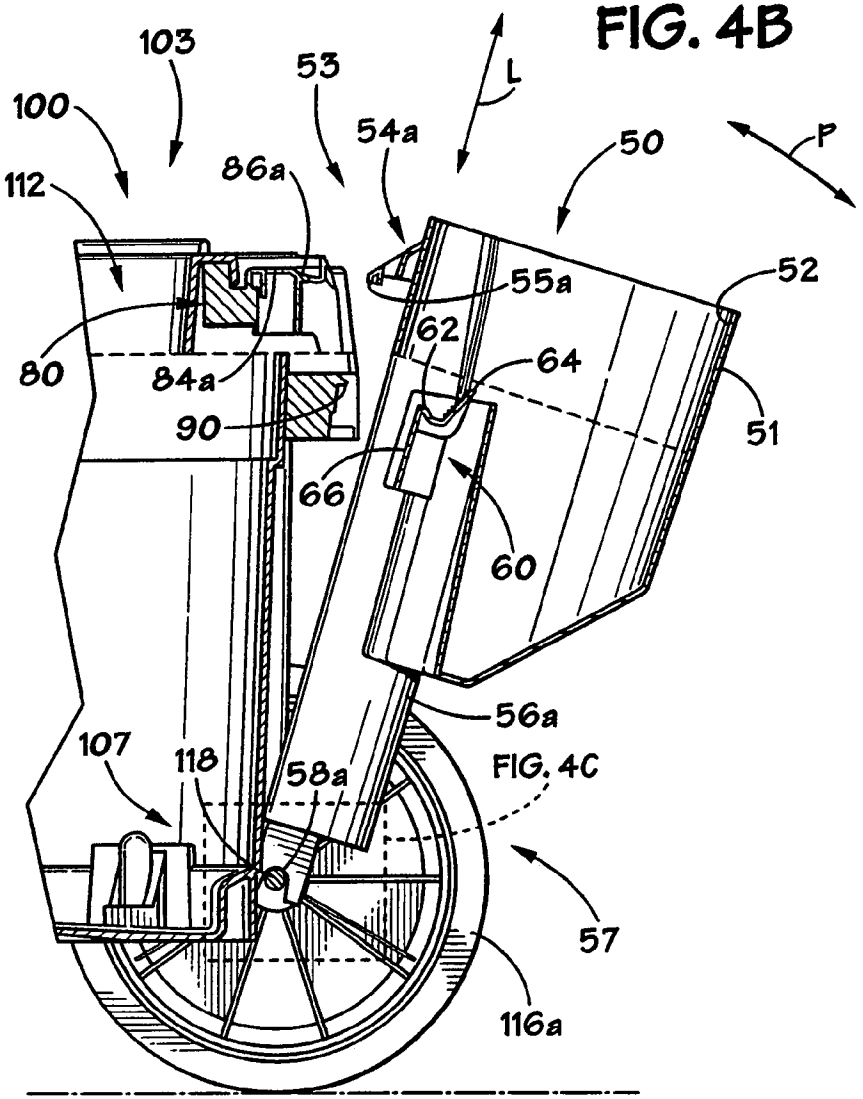

DETACHABLE ACCESSORY HOLDER

BACKGROUND OF INVENTION

1. Field of the Invention

The present invention relates generally to a detachable holder for storing tools or accessories on an appliance and, more particularly to a holder storing accessories on a wet/dry vacuum and being securably attachable to and readily detachable from the vacuum.

2. Description of the Related Art

Vacuums may include holders for storing accessories, such as brushes, crevice tools, extension wands, end fitting, etc. In some examples, the holders are permanently secured to the vacuum and cannot be readily removed. In other examples, the holders are portable and detachable members that are independent of the vacuum. Detachable holders are especially desirable, for example, when an operator empties debris from a drum of a wet/dry vacuum.

Unfortunately, existing detachable holders for accessories on wet/dry vacuums have some disadvantages. Some existing detachable holders slip fit onto the vacuum and do not positively latch or attach to a feature on the vacuum. With such a slip fit, the detachable holder can work loose and possibly fall off during use or movement of the vacuum. In addition, some existing detachable holders hang on posts or tabs attached to the vacuum. These detachable holders are not fully supported by the posts or tabs and may spill the accessories or catch on stairs when the vacuum is hauled or moved.

For example, a detachable holder 30 for accessories as exemplified in the prior art is illustrated in FIG. 1. The holder 30 is shown in relation to a wet/dry vacuum 10. The vacuum 10 has a drum 12 and a handle 14. A bracket 20 mounts to the back of the vacuum 10 adjacent the handle 14. Two tabs 22*a* and 22*b* having a T-shape are located on the handle bracket 20. Two slots 34*a* and 34*b* are positioned on the holder 30. The holder 30 is placed adjacent the bracket 20. To attach the holder 30 to the bracket 20, the tabs 22*a* and 22*b* position through the slots 34*a* and 34*b*, and the holder 30 hangs from the tabs 22*a* and 22*b*. The holder 30 is designed for easy removal. Unfortunately, being held only with the tabs 22*a* and 22*b*, the holder 30 may tip when the vacuum is moved. Furthermore, the holder 30 may catch on stairs when the vacuum is tilted and moved on a staircase. To permanently attach the holder 30 to the vacuum 10, an operator may strap the bottom of the holder 30 to the vacuum 10, which does not allow for easy detachment.

The present invention is directed to overcoming, or at least reducing the effects of, one or more of the problems set forth above.

SUMMARY OF THE INVENTION

In one embodiment, among others, the present invention provides a holder for storing accessories on a wet/dry vacuum. The holder securely attaches to the vacuum and readily detaches therefrom. The accessory holder detachably couples to a pivot location on the vacuum and secures to the vacuum. The secure attachment prevents the holder from falling off or tipping on the vacuum. To attach the holder to the vacuum, grooves on the holder are pivotably coupled to an axle of the vacuum. The holder is then pivoted about the axle. Tabs on the holder engage slots on a bracket attached to the vacuum. A flexible latch on the holder aligns with a step on the bracket. To remove the holder, the operator presses on the latch to disengage it from the step, and the operator lifts the holder from the bracket and the vacuum.

The foregoing summary is not intended to summarize each potential embodiment or every aspect of the invention disclosed herein, but merely to summarize some aspects of the present invention, among other aspects.

BRIEF DESCRIPTION OF DRAWINGS

The foregoing summary, a preferred embodiment, and other aspects of the present invention will be best understood with reference to a detailed description of specific embodiments of the invention, which follows, when read in conjunction with the accompanying drawings, in which:

FIG. 4B illustrates a cross-sectional view of FIG. 4A.

FIG. 4C illustrates another embodiment of a pivot point on the accessory holder and a pivot location on the vacuum for FIG. 4B.

Figure 1:
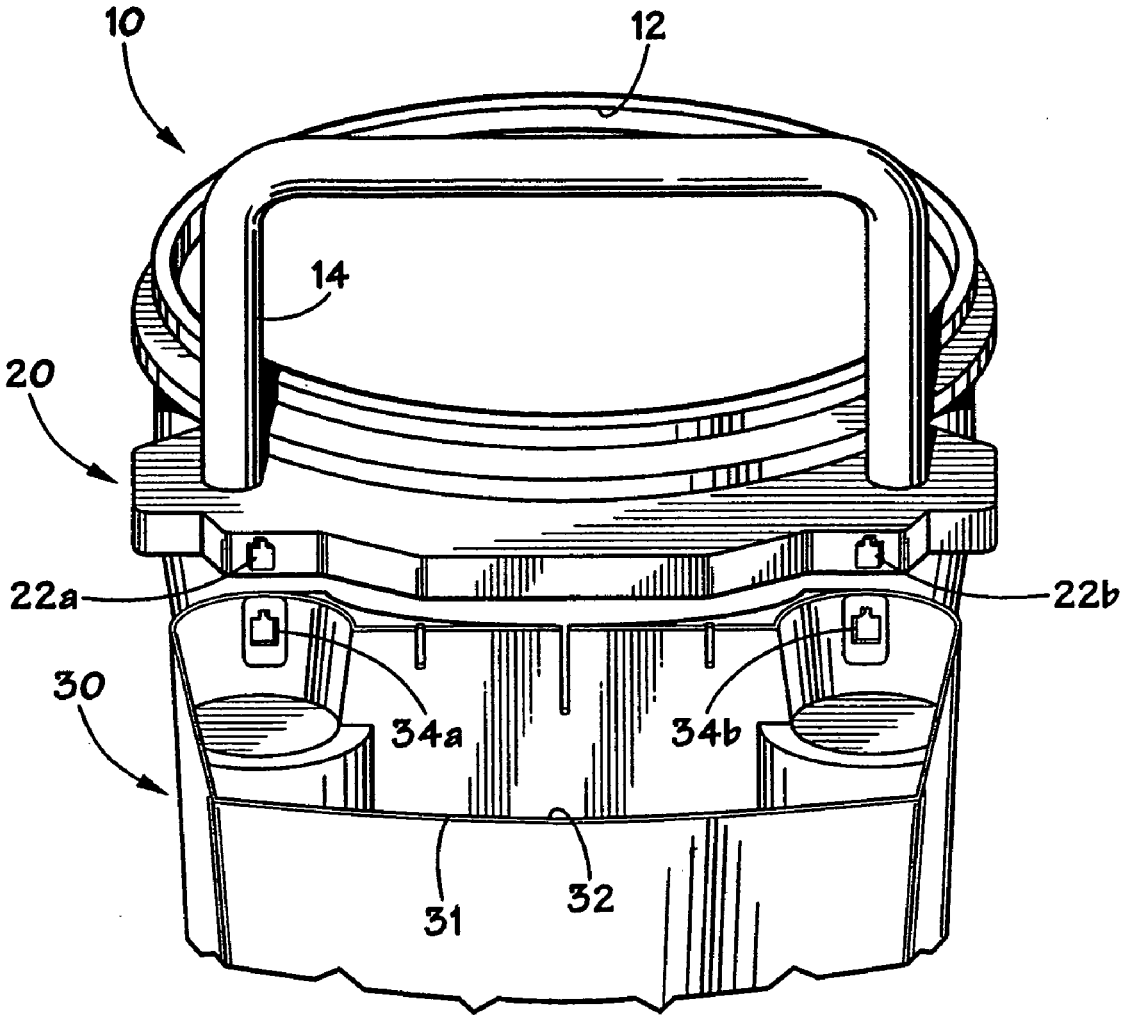
FIG. 1 (PRIOR ART)
FIG. 1 illustrates an accessory holder according to the prior art in relation to a wet/dry vacuum.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives failing within the scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual implementation, numerous implementation-specific decisions must be made to achieve the developers" specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2B:
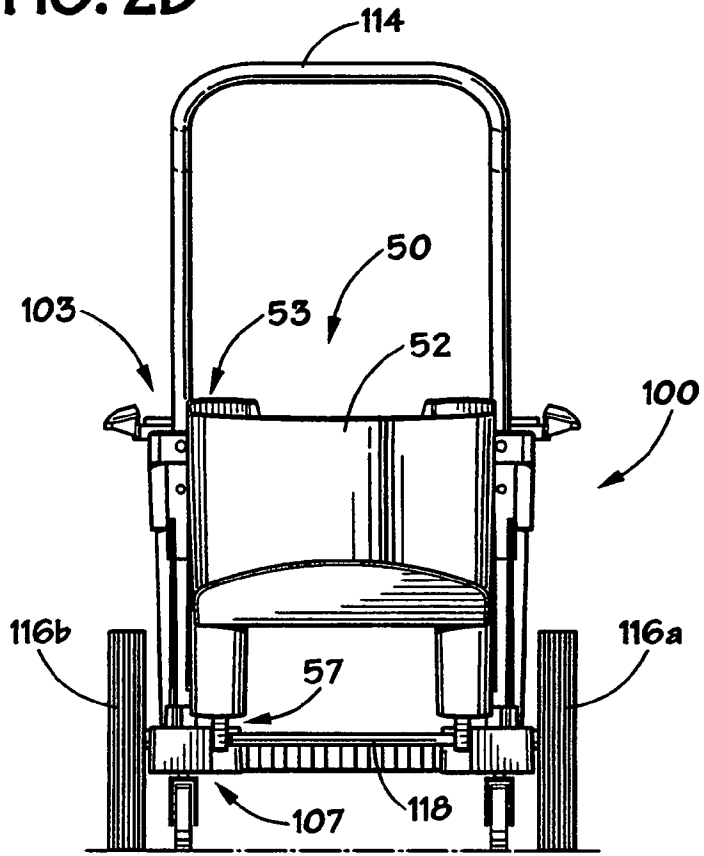
FIGS. 2A–B illustrates a side view and a back view of a detachable accessory holder and an appliance in accordance with the present invention.
Figure 2A:
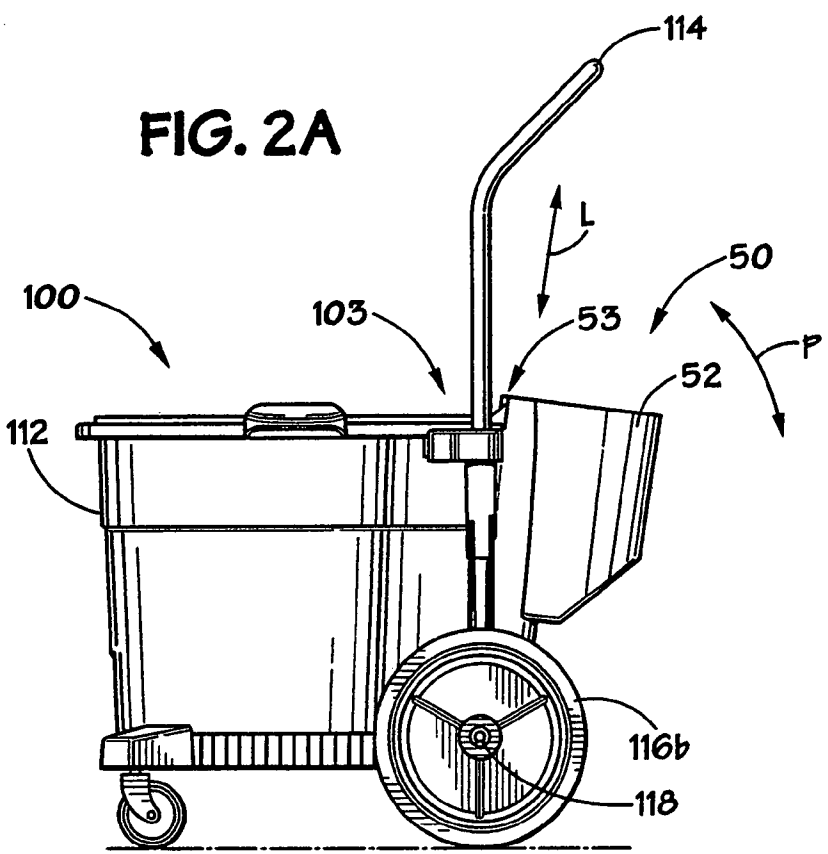

Referring to FIGS. 2A and 2B, an embodiment of an accessory holder 50 for holding accessories is illustrated attached to an appliance 100 in accordance with the present invention. In FIG. 2A, the accessory holder 50 and appliance 100 are illustrated in a side view. In FIG. 2B, the accessory holder 50 and appliance 100 are illustrated in a back view.

In the present embodiment of the invention, the appliance 100 for use with the accessory holder 50 is a wet/dry vacuum. The vacuum includes a drum 112, a handle 114, wheels 116*a* and 116*b*, and an axle 118. For convenience, the motor portion of the vacuum 100 is not shown. Although the present embodiment of the accessory holder 50 is illustrated for use with the wet/dry vacuum 100, it is understood that the present invention is applicable to, but not limited to, standard vacuums, carpet cleaning machines, or other appliances having accessories. Having a detachable accessory holder 50 for such appliances may be beneficial when they require movement, maintenance, cleaning, or storage.

The accessory holder 50 stores accessories or tools (not shown) for use with the vacuum 100. The holder 50 may be composed of a lightweight and sturdy material, such as polypropylene. The accessory holder 50 includes a compartment 52 for storing accessories (not shown). The holder 50 securely attaches to the appliance 100 and easily detaches therefrom.

To attach the holder 50 to the vacuum 100, a pivot portion 57 situated at a lower end of the holder 50 removably and rotatably couples to a pivot portion 107 on the vacuum 100. In the present embodiment, the pivot location 107 is the axle 118 of the vacuum 100. It is understood, however, that the pivot location 107 can include any fixed location on the vacuum 100 allowing for the holder 50 to pivot thereon. In one example, the pivot location 107 can be one or more pegs (not shown) extending from the drum 112 of the vacuum 100.

Once coupled to the axle 118, the holder 50 is rotated on the axle 118 towards the vacuum 100. A connection portion 53 situated at an upper end of the holder 50 is positioned adjacent the vacuum 100 and is positively coupled to a connection portion 103 of the vacuum 100. The positive coupling of the holder 50 at least restricts the holder 50 from being pivoted away from the vacuum 100. The holder 50 is held onto the vacuum 100 by the coupling of the pivot portion 57 with the axle 118 and the coupling of the connection portion 53 with the connection portion 103 of the vacuum 100. In a preferred embodiment of the present invention, the holder 50 is restricted from being moved away from the vacuum 100 in at least two directions. Preferably, the holder 50 is restricted from being pivoted or rotated away from the vacuum 100 in a first or rotational direction P and from being lifted off the vacuum 100 in a second or radial direction L.

Figure 3B:
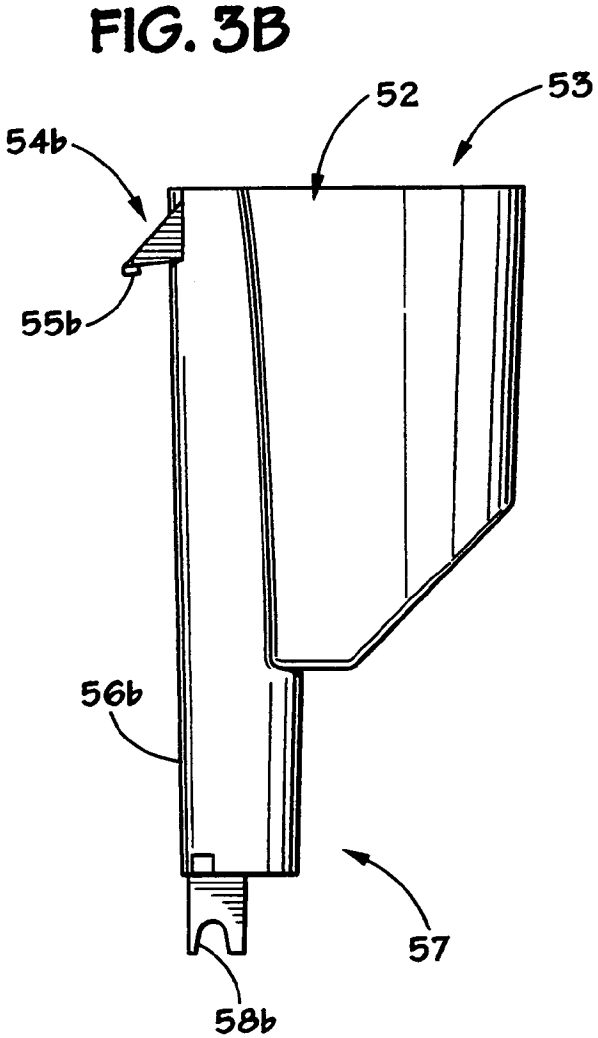
FIGS. 3A–B illustrate a frontal view and a side view of an embodiment of a detachable accessory holder in accordance with the present invention.
Figure 3A:
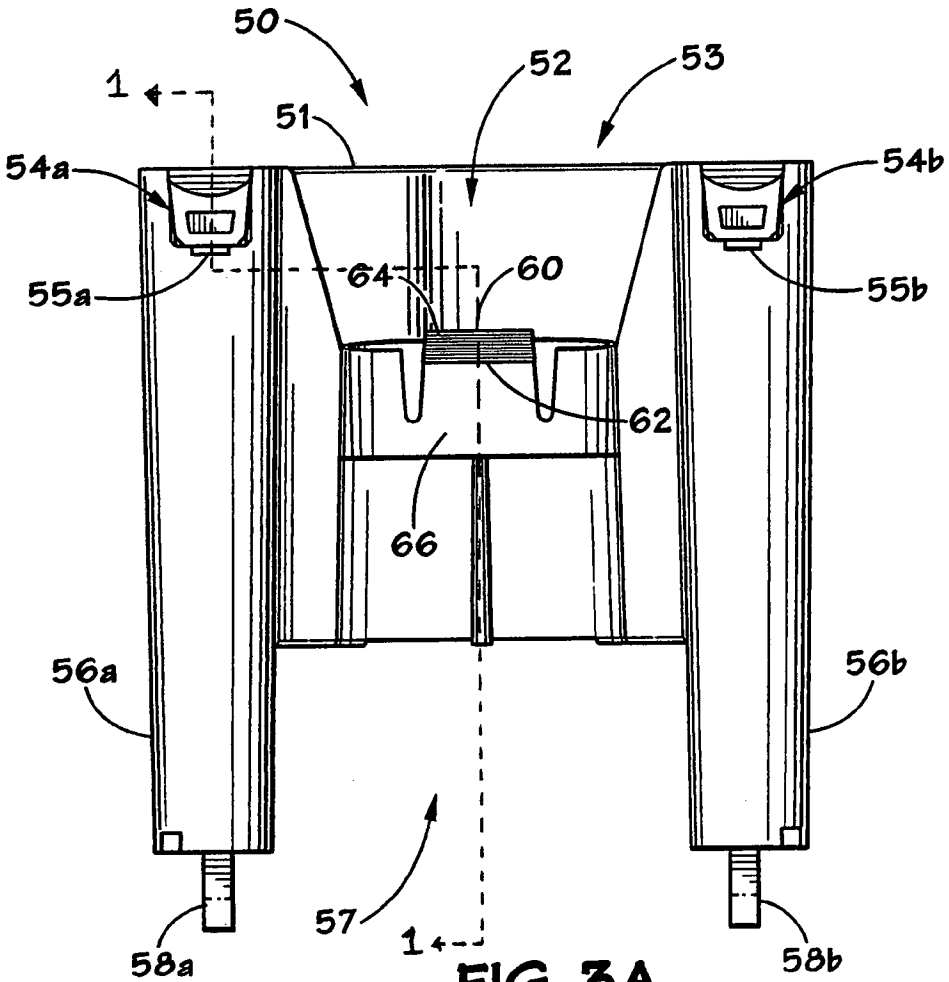

Referring to FIGS. 3A–B, an embodiment of the accessory holder 50 is illustrated in front and side views. The accessory holder 50 includes a sidewall 51, which defines a compartment 52 for holding or storing the accessories. Although the present embodiment of the holder 50 includes the compartment 52 for storing the accessories, it is understood that other arrangements for holding accessories known in the art are also applicable to the present invention. For example, the holder 50 can include a system of racks (not shown) to which the accessories mount.

For the pivot portion 57 situated at the lower end of the holder 50, the holder 50 includes one or more pivot points or grooves 58*a* and 58*b*. In the present embodiment, the compartment 52 does not fully extend along the entire backside of the vacuum 100 so that the holder 50 includes extensions or legs 56*a* and 56*b*. Each leg 56*a* and 56*b* includes one of the pivot points or grooves 58*a* and 58*b* on its distal end. The pivot points or grooves 58*a* and 58*b* detachably couple with the pivot location or axle of the vacuum, as best shown and described below with reference to FIGS. 4–8. Preferably, the holder 50 includes two pivot points or grooves 58*a* and 58*b* distanced to extreme sides of the compartment 52 for better stability when the holder 50 is coupled to the axle and pivoted thereabout as described below.

For the connection portion 53 situated at the upper end of the holder 50, the holder 50 includes one or more first or male members 54*a* and 54*b* projecting from the side of the holder 50. The first members 54*a* and 54*b* include tabs 55*a* and 55*b* having ends facing towards the pivot points or grooves 58*a* and 58*b*. The first or male members 54*a* and 54*b* positively couple to the vacuum 100, as described below. When positively coupled, the first members 54*a* and 54*b* restrict the holder 50 from being detached from the vacuum in at least one direction, i.e., pivoted away from the vacuum. Preferably, the holder includes two members 54*a* and 54*b* distanced to extreme sides of the compartment 52 for better stability when the holder 50 is attached to the vacuum 100 as described below.

The accessory holder 50 also includes a movable or retractable member 60 disposed on the holder 50. The movable or retractable member 60 is a latch flexibly attached to the side of holder 50. The latch 60 is preferably positioned between the members 54*a* and 54*b*. In this way, the latch 60 is accessible by an operator from the upper end 53 of the holder 50.

The latch 60 includes the first positive stopping surface or shoulder 62, an operator surface 64, and a flexible portion 66. The first positive stopping surface or shoulder 62 faces away from the pivot or grooves 58*a* and 58*b* and engages another stopping surface on the vacuum, as described below. Once engaged with the vacuum, the latch 60 selectively permits or restricts detachment of the holder 50 from the vacuum in the second or radial direction away from the pivot location or axle, as described below. The operator surface 64 may be corrugated, permitting easy recognition and use of the latch 60 by the operator. The flexible portion 66 enables the latch 60 to be selectively engaged or disengaged as described below.

Figure 4A:
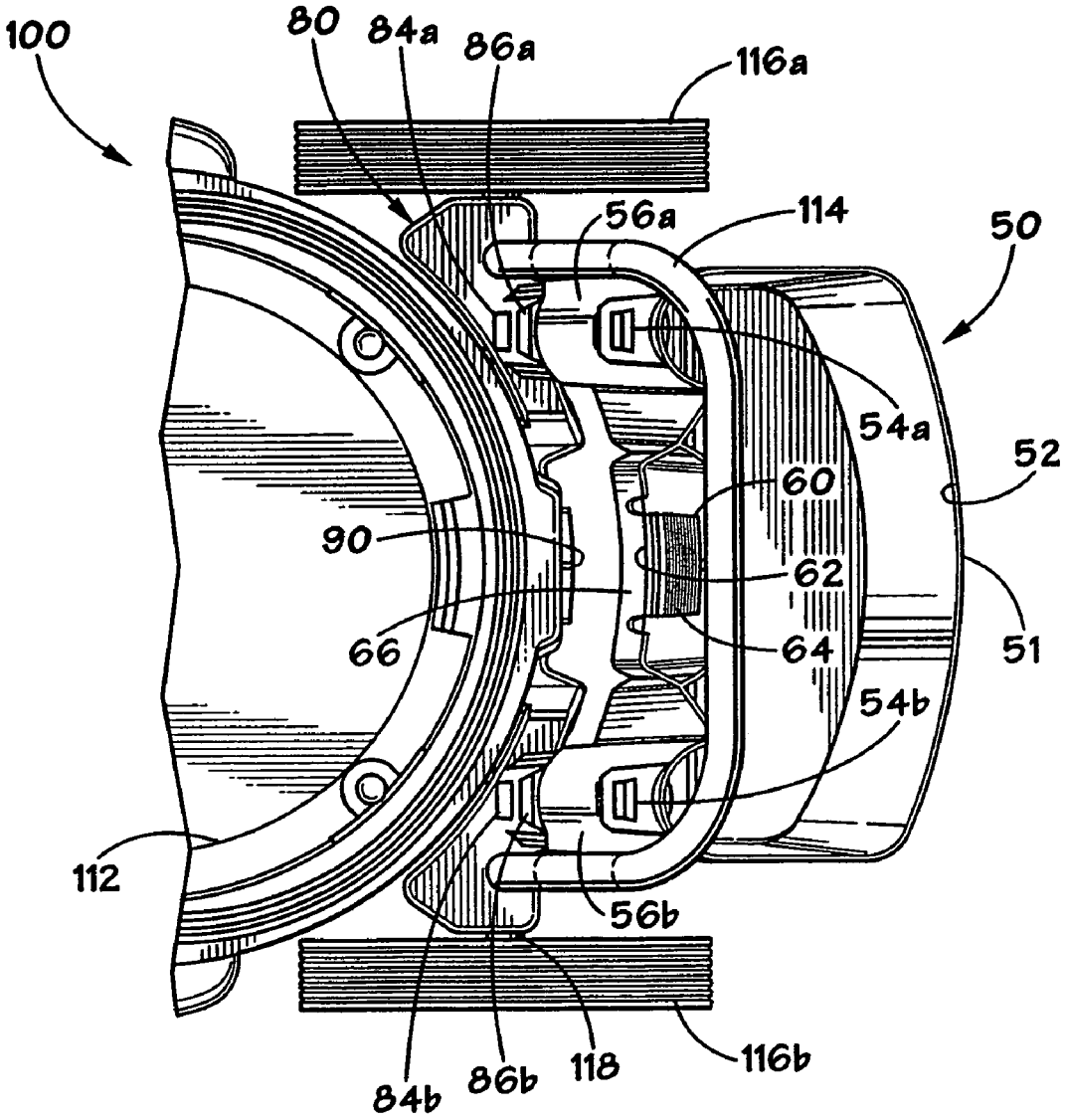
FIG. 4A illustrates a top view of the detachable accessory holder in a stage of attachment to the bracket and vacuum.

The secure attachment and easy detachment of the preferred embodiment of the accessory holder 50 will now be discussed with reference to FIGS. 4–8. Referring to FIGS. 4A–B, the accessory holder 50 is shown in a first stage of attachment to the vacuum 100. In FIG. 4A, the accessory holder 50 and the vacuum 100 are illustrated in a top view. In FIG. 4B, the accessory holder 50 and the vacuum 100 are illustrated in cross-section. For convenience, the accessory holder 50 in FIG. 4B is illustrated in an uneven cross-section 1—1 shown in FIG. 3. The uneven cross-section 1—1 permits a view of tab 54*a* and latch 60, which are not axially aligned on the holder 50.

The accessory holder 50 mounts to the vacuum 100 by first positioning or detachably connecting the grooves, such as the groove 58*a* shown, on the pivot location or axle 118 of the vacuum 100. The holder 50 is rotatable relative to the vacuum 100 in a first or rotational direction P about the axle 118. In an alternative embodiment shown in FIG. 4C, the pivot portion 57 at the lower end of the holder 50, such as the leg 56*a* shown, can include a rounded protrusion or knuckle 59*a*. In this instance, the pivot portion or pivot location on the vacuum 100 is a rounded indentation or notch 117 attached to the drum 112. This reversed pivot configuration works similarly to the groove and axle configuration discussed herein. Accordingly, a number of detachably coupling and rotatable configurations known in the art are applicable to the present invention. For example, the configuration can include a ball and socket or other configuration allowing for a detachable and rotatable coupling or joint.

In one embodiment of the present invention, the vacuum 100 includes a bracket 80 for the connection portion of the appliance. The bracket 80 is attached to an upper portion of the appliance 100 for positively coupling with the connection portion 53 at the upper end of the accessory holder 50. As best shown in FIG. 4A, the bracket 80 is attached to the back of the vacuum 100 adjacent the handle 114. For convenience, the bracket 80 in FIG. 4B is illustrated in an uneven cross-section 2—2 shown in FIG. 5B. The uneven cross-section 2—2 permits a view of components, which are not axially aligned on the bracket 80.

Although the embodiment disclosed herein includes the bracket 80 attached to the vacuum 100, it will be appreciated by one of ordinary skill in the art that having the bracket 80 as a separately attached component to the vacuum 100 facilitates manufacture of the vacuum 100. Therefore, it is understood that elements and features of the bracket 80 may be integral to the vacuum 100 in other embodiments of the present invention.

Figure 5A:
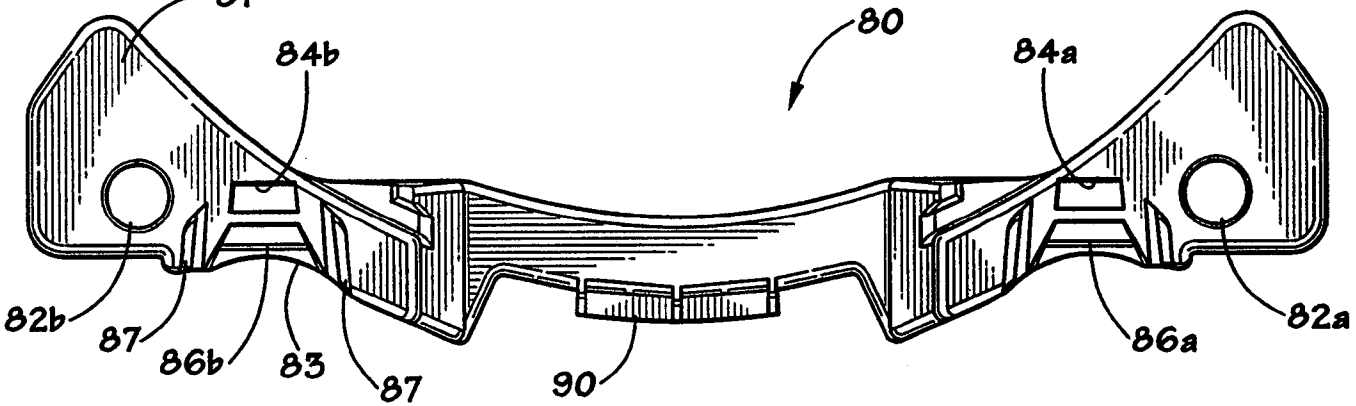
FIGS. 5A–B illustrate a top view and frontal view of an embodiment of a bracket in accordance with the present invention.
Figure 5B:
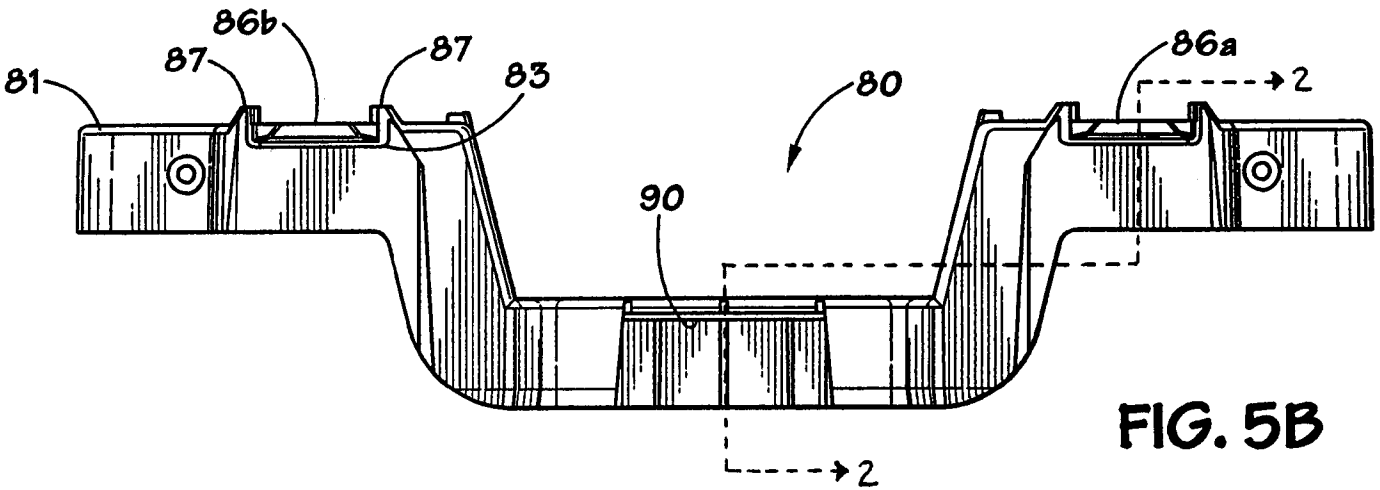

Referring to FIGS. 5A–B, the bracket 80 is illustrated in an isolated top view and a frontal view. The bracket 80 may be composed of a lightweight and sturdy material, such as polypropylene. In an upper surface 81, the bracket 80 defines openings 82*a* and 82*b* for the handle. The bracket 80 includes one or more second or female members 84*a* and 84*b*, which are slots in the present embodiment. The slots 84*a* and 84*b* are defined in the upper surface 81 at opposite ends of the bracket 80. The slots 84*a* and 84*b* are distanced equivalent to the first members 54*a* and 54*b* on the holder 50 to which they positively couple (See FIG. 4A).

In a preferred embodiment of the present invention, the bracket 80 also includes inclined structures or ramps 86*a* and 86*b* facilitating the attachment of the holder to the bracket 80. The ramps 86*a* and 86*b* are disposed adjacent the slots 84*a* and 84*b*. As best shown in FIG. 5B, the ramps 86*a* and 86*b* extend from an edge 83 of the bracket 80 and incline towards the slots 84*a* and 84*b*.

As will be discussed in more detail below, the ramps 86*a* and 86*b* engage or interact with the first members 54*a* and 54*b* of the holder 50 when attaching to the bracket 80. Advantageously, the ramps 86*a* and 86*b* allow the operator to attach or secure the holder 50 to the bracket 80 in a single pivoting motion. In addition, the ramps 86*a* and 86*b* may further include guides 87 to direct the first members 54*a* and 54*b* to the slots 84*a* and 84*b*.

The bracket 80 also includes a second positive stopping surface or retaining step 90. The second positive stopping surface 90 is intended to engage or align with the first positive stopping surface 62 of the latch 60, as best shown and described below. The first and second positive stopping surfaces 62 and 90 at least restricts the holder 50 from being lifted off the vacuum.

Figure 6:
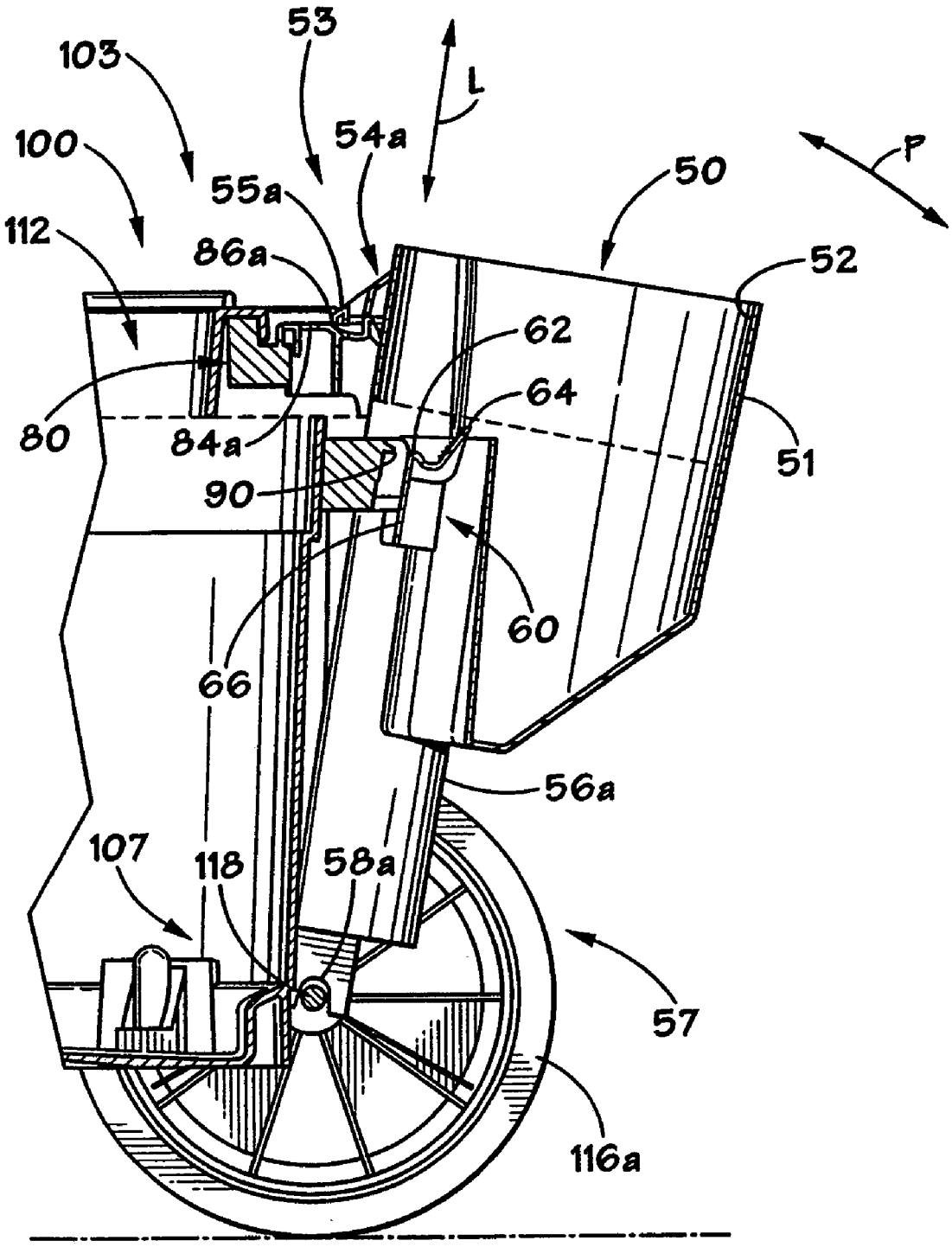
FIG. 6 illustrates a cross-sectional view of the detachable accessory holder in another stage of attachment to the bracket and vacuum.

Referring now to FIG. 6, the accessory holder 50 is illustrated in a further stage of attachment to the vacuum 100. The accessory holder 50 is further rotated about the axle 118 towards the vacuum 100 in the first or rotational direction P. The two first members 54*a* and 54*b* of the accessory holder 50 engage the ramps 86*a* and 86*b* of the bracket 80. The first members 54*a* and 54*b* are moved towards the adjacent slots 84*a* and 84*b* defined in the bracket 80.

As the first members 54*a* and 54*b* ride on the ramps 86*a* and 86*b*, the accessory holder 50 is raised upward or displaced in a second or radial direction L away from the axle 118. The displacement of the holder 50 eventually allows the first members 54*a* and 54*b* to insert into the slots 84*a* and 84*b*, as detailed below. The grooves 58*a* and 58*b* slightly separate from or rise off the axle 118, as the holder 50 is moved in the second or radial direction L. Therefore, the grooves 58*a* and 58*b* are preferably deep enough to remain coupled to the axle 118.

Figure 7:
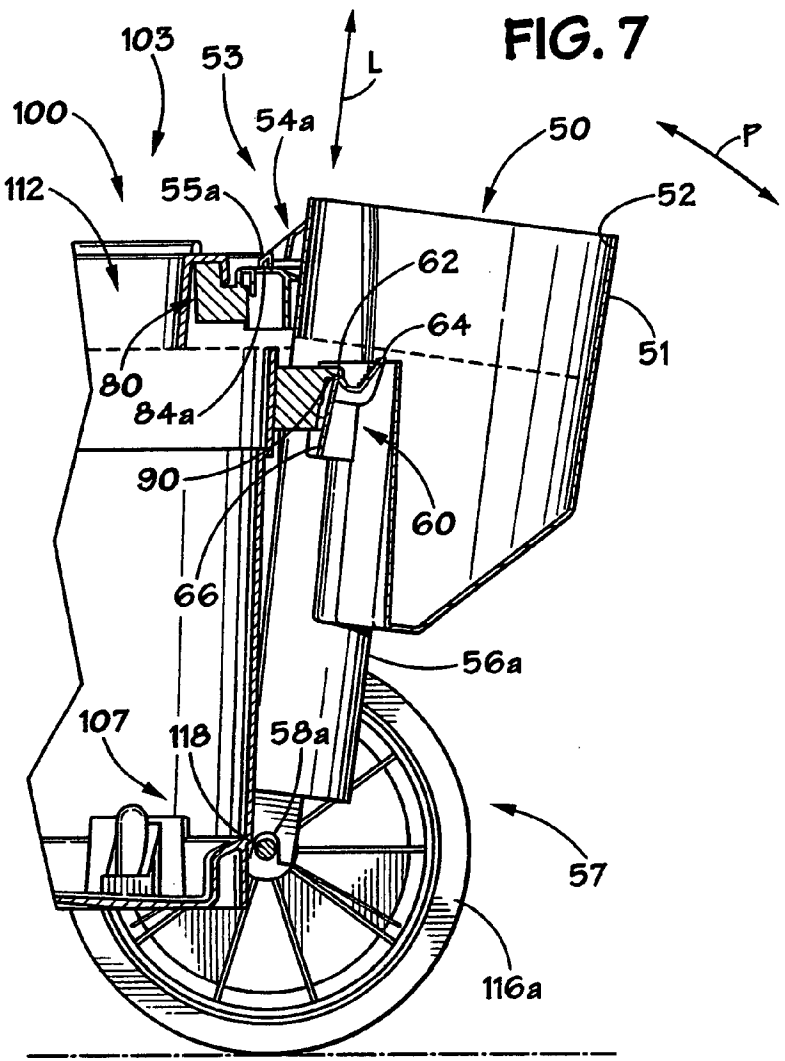
FIG. 7 illustrates a cross-sectional view of the detachable accessory holder in yet another stage of attachment to the bracket and vacuum.

Referring now to FIG. 7, the accessory holder 50 is illustrated in yet a further stage of attachment to the vacuum 100. As pivoting of the holder 50 is continued in the first or rotational direction P, the first members 54*a* and 54*b* position to a point of nearly inserting or dropping into the slots 84*a* and 84*b*. The latch 60 of the holder 50 contacts the retaining step 90 of the bracket 80 and flexes at the flexible portion 66.

Figure 8:
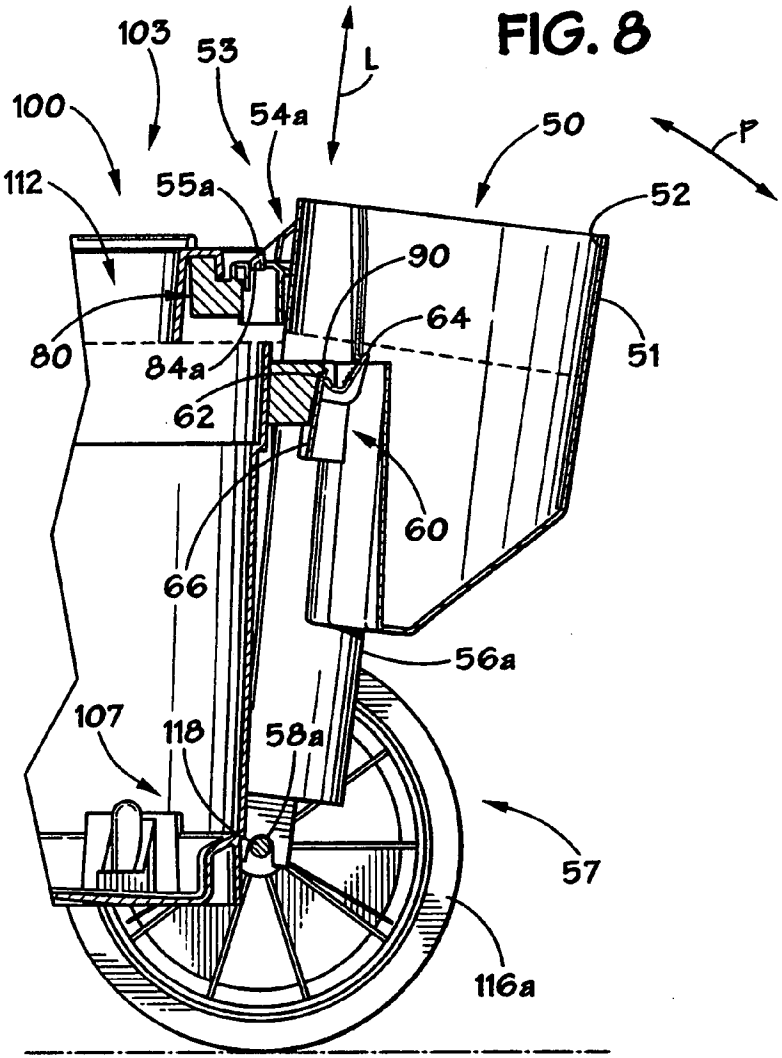
FIG. 8 illustrates a cross-sectional view of the detachable accessory holder completely attached to the bracket and vacuum.

Referring to FIG. 8, the accessory holder 50 is shown in a completed stage of attachment to the vacuum 100. With the continued pivot of the holder 50 in the first or rotational direction P from that illustrated in FIG. 7, the first members 54*a* and 54*b* position over the slots 84*a* and 84*b*. The slots 84*a* and 84*b* receive the first members 54*a* and 54*b* therein, as the holder 50 moves in the second or radial direction L towards the axle 118. With the tabs 55*a* and 55*b* disposed in the slots 84*a* and 84*b*, detachment of the holder 50 is restricted from the bracket 80 in the first direction P.

As the holder 50 drops or moves towards the axle 118, the shoulder 62 of the latch 60 surpasses or moves past the retaining step 90 of the bracket 80. The latch 60 flexes back to its equilibrium position, and the shoulder 62 and step 90 align or engage with one another, as illustrated in FIG. 8. The alignment or engagement of the shoulder 62 with the step 90 restricts detachment of the holder 50 from the bracket 80 in the second or radial direction L away from the axle 118. Thus, the shoulder 62 and step 90 prevent the holder 50 from inadvertently being lifted up and off its mounted or attached position.

Continuous engagement or contact between the shoulder 62 and the step 90 is not necessary to prevent detachment or removal of the holder 50. In general, the holder 50 is constrained from moving in the second direction L by the force of gravity. Accordingly, the shoulder 62 and step 90 need only be aligned for potential engagement with one another if the vacuum 100 is tilted or moved. Overall, the holder 50 is constrained by the engagement or coupling of the grooves 58*a* and 58*b* with the axle 118, by the engagement or coupling of the first members 54*a* and 54*b* with the slots 84*a* and 84*b*, and by the alignment or engagement of the shoulder 62 with the step 90.

To remove the accessory holder 50, the shoulder 62 of the latch 60 can be selectively disengaged from or unaligned with the step 90 on the bracket 80. The latch 60 is simply pressed or flexed back by the operator until the shoulder 62 clears the step 90. The accessory holder 50 is then unrestricted and is permitted to move in the second or radial direction L. The holder 50 can be lifted, removing the first members 54*a* and 54*b* from the slots 84*a* and 84*b* and uncoupling the grooves 58*a* and 58*b* from the axle 118. The holder 50 is then free of the bracket 80 and the vacuum 100.

As evidenced above in the preferred embodiment, the first members 54*a* and 54*b* and the slots 84*a* and 84*b* act together to restrict detachment of the holder 50 from the bracket 80 in the first or rotational direction P. It is considered an equivalent structure if the connection portion of the holder 50 includes female members, such as slots defined in the holder 50, and if the connection portion of the appliance 100 includes male members, such as tabs disposed on the bracket 80 or upper end of the appliance 100. For example, such tabs may project from the bracket 80 and may have ends pointing upwards. The slots defined in the holder 50 may face down and lift over and onto the up-turned tabs during the pivoting action.

Furthermore, ramps on the connection portion of the holder 50 may be disposed adjacent slots defined in the holder 50. These ramps may have an inverted inclination so that they lift the holder 50 or move the holder 50 away from axle 118 when engaging the up-turned tabs on the bracket 80. This opposite tab/slot arrangement performs the same functions as other embodiments described herein. For brevity, this alternative embodiment of the present invention is not illustrated, as one of ordinary skilled in the art may readily make and use the opposite tab/slot arrangement with the benefit of the present disclosure.

The first members 54*a* and 54*b* and slots 84*a* and 84*b* in the embodiment illustrated in the FIGS. 5–8 offer one structure to restrict movement of the holder 50 in the first or rotational direction P. Other equivalent structures for restricting movement of the holder 50 in the first or rotational direction P can include, but are not limited to, other suitable male and female members, such as hooks and slots, T-shaped structures and respective apertures, or catches and nooks. The design and implementation of such equivalent structures for restricting movement of the holder 50 in the first or rotational direction P fall within the ordinary skill of one in the art with the benefit of the present disclosure.

As also evidenced above in the preferred embodiment, the shoulder 62 and the step 90 act together to restrict detachment of the holder 50 from the bracket 80 in the second or radial direction L away from the axle 118. It is considered an equivalent structure if a latch having a shoulder is flexibly attached on the bracket 80 and a retaining step disposed on the holder 50. The shoulder on the latch may face downward or towards the pivot location 118, and the step on the holder 50 may face upwards or away from the pivot points 58*a* and 58*b* on the holder 50. This reversed shoulder/step arrangement performs the same functions as other embodiments described herein. For brevity, this alternative embodiment of the present invention is not illustrated, as one of ordinary skilled in the art may readily make and use this reversed shoulder/step arrangement with the benefit of the present disclosure.

As evidenced above in the preferred embodiment of the invention, the ramps 86*a* and 86*b* advantageously allow the operator to attach or secure the holder 50 to the bracket 80 in a single pivoting motion. Although not preferred, the bracket 80 may not include these ramps 86*a* and 86*b*, thereby requiring the operator to slightly lift the holder 50 to insert the first members 54*a* and 54*b* into the slots 84*a* and 84*b*. Alternatively, the first members 54*a* and 54*b* on the holder 50 can themselves include an inclined structure on the end to contact the edge 83 of the bracket 80 and displace the holder 50 in the second or radial direction L.

Moreover, to displace the holder 50 in the second direction L during pivoting in the first direction P, an inclined structure or ramp can be disposed on the holder 50 or bracket 80 independently located from the tabs 55*a*, 55*b* and slots 84*a*, 84*b*. Such an independent structure can be used to displace the holder 50 and mate the tabs 55*a* and 55*b* and slots 84*a* and 84*b* in the second or radial direction L. Such alternative inclined structures for displacing the holder 50 in the second or radial direction L fall within the ordinary skill of one in the art with the benefit of the present disclosure.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

The invention claimed is:

1. An appliance having accessories comprising:

a first pivot portion on the appliance;

a first connection portion on the appliance;

a holder for holding the accessories being removable from the appliance;

a second pivot portion on the holder being rotatably connectable to the first pivot portion of the appliance, the first and second pivot portions permitting rotation of the holder in a rotational direction when connected; and a second connection portion on the holder being positively coupleable to the first connection portion of the appliance, the first and second connection portions at least restricting removal of the holder from the appliance in the rotational direction when positively coupled.

2. The appliance of claim 1, wherein the appliance is a vacuum.

3. The appliance of claim 1, wherein the second pivot portion of the holder comprises a groove defined at a lower end of the holder.

4. The appliance of claim 3, wherein the first pivot portion of the appliance comprises an axle on the appliance.

5. The appliance of claim 1, wherein the second connection portion of the holder comprises a tab situated at an upper end of the holder.

6. The appliance of claim 5, wherein the first connection portion of the appliance comprises a slot defined at an upper end of the appliance.

7. The appliance of claim 6, wherein the tab positively couples to the slot in a first radial direction.

8. The appliance of claim 7, wherein the first connection portion of the appliance comprises a ramp adjacent the slot and engaging the tab of the second connection portion, the ramp displacing the holder in a second radial direction opposite the first radial direction.

9. The appliance of claim 1, further comprising a movable member on the holder selectively permitting or restricting removal of the holder from the appliance in a radial direction.

10. The appliance of claim 9, wherein the movable member comprises a first positive stopping surface being movable relative to a second positive stopping surface on the appliance.

11. A device for an appliance having accessories comprising:

means for holding the accessories;

means for removably connecting the holding means to the appliance, the holding means being rotatable in a rotational direction about the removably connecting means; and first means for restricting removal of the holding means from the appliance in the rotational direction.

12. The device of claim 11, wherein the removably connecting means comprises a groove defined at a lower end of the holding means.

13. The device of claim 12, wherein the groove removably and rotatably connects to an axle of the appliance.

14. The device of claim 11, wherein the first restricting means comprises a connection portion of the holding means positively coupleable to the appliance in a first radial direction.

15. The device of claim 14, wherein the connection portion comprises a tab situated at an upper end of the holding means.

16. The device of claim 15, wherein the tab is positively coupleable to a slot defined at an upper end of the appliance.

17. The device of claim 14, further comprising means for displacing the first member in a second radial direction opposite the first radial direction.

18. The device of claim 11, further comprising second means for restricting removal of the holding means from the appliance in a radial direction.

19. The device of claim 18, wherein the second restricting means comprises a first positive stopping surface on the holding means movable relative to a second positive stopping surface on the appliance.

* * * * *